United States Patent [19]

Jones et al.

[11] Patent Number: 4,460,635

[45] Date of Patent: Jul. 17, 1984

[54] METHOD OF FORMING COATINGS, COATINGS SO FORMED AND ARTICLES COATED THEREBY

[75] Inventors: Graham T. Jones; Warren S. Dow; Geoffrey L. Wearne, all of Auckland, New Zealand

[73] Assignee: AHI Operations Limited, Manukau, New Zealand

[21] Appl. No.: 516,426

[22] Filed: Jul. 22, 1983

Related U.S. Application Data

[63] Continuation of Ser. No. 307,682, Oct. 1, 1981, abandoned, which is a continuation of Ser. No. 102,656, Dec. 12, 1979, abandoned.

[30] Foreign Application Priority Data

Dec. 14, 1978 [NZ] New Zealand ..... 189172
Jun. 27, 1979 [NZ] New Zealand ..... 190864

[51] Int. Cl.[3] ..... B05D 1/12

[52] U.S. Cl. ..... 428/142; 427/186; 428/150; 428/331; 428/489

[58] Field of Search ..... 428/142, 150, 331, 489; 427/186

[56] References Cited

U.S. PATENT DOCUMENTS 4,267,221 5/1981 Ishikawa ..... 428/150

*Primary Examiner*—Marion McCamish
*Attorney, Agent, or Firm*—Holman & Stern

[57] ABSTRACT

A method of coating articles, a coating and a coated article wherein a bitumen primer layer is applied to a base sheet material and while the bitumen primer layer is still wet a layer of a barrier material of a consistency, composition and thickness is applied to the primer layer such that the bitumen primer layer does not bleed through the barrier layer and the barrier layer adheres to the bitumen primer layer. A coating of stone chips is then applied to the barrier layer in a manner such that the stone chips are partially embedded at least in the barrier layer so that the stone chips are held in position on curing of the bitumen primer and barrier layer but the stone chips are not completely covered by the barrier layer.

8 Claims, 3 Drawing Figures

METHOD OF FORMING COATINGS, COATINGS SO FORMED AND ARTICLES COATED THEREBY

This is a continuation of application Ser. No. 307,682 filed Oct. 1, 1981, now abandoned, which in turn is a Rule 60 continuation of U.S. Ser. No. 102,656, filed Dec. 12, 1979 (now abandoned).

BACKGROUND OF THE INVENTION

1. Field of the Invention

This invention relates to methods of forming coatings, coatings so formed, and articles coated thereby and has been devised particularly though not solely for use as a coating for weatherproof building cladding for example roofing tiles.

2. Description of the Prior Art

Coating systems using chips adhered to a metal tile by a bonding layer hitherto used for coating in particular roofing tiles have had disadvantages in that the bond between the chip and tile has allowed depressions in which growth such as lichen can grow. Also, ultra violet degradation has occurred. Each of these factors has caused the chips to be loosened and ultimately to fall from the tile.

SUMMARY OF THE INVENTION

It is an object of the present invention to provide methods of forming coatings, coatings so formed, and articles coated thereby which will obviate or minimise the foregoing disadvantages or which will at least provide the public with a useful choice.

Accordingly, in one aspect the invention consists of a method of coating articles, said method comprising the steps of applying to a base sheet material, a bitumen primer layer and while the bitumen primer layer is still wet applying a layer of an ultraviolet apaque barrier material of a consistency, composition and thickness such that the bitumen primer layer does not bleed through the barrier layer and the barrier layer adheres to the bitumen primer layer and applying a coating of stone chips to the barrier layer in a manner such that the stone chips are partially embedded at least in the barrier layer, which has a viscosity and surface tension that permits capillarization by the barrier layer around the chips so that the stone chips are held in position on curing of the bitumen primer and barrier layer but the stone chips are not completely covered by the barrier layer.

In a further aspect, the invention consists in a coating for an article comprising a bitumen primer layer, a layer of an ultraviolet apaque barrier material applied to said bitumen primer layer while said bitumen primer layer is still wet, said barrier layer being of a consistency, composition and thickness such that the bitumen primer layer does not bleed through the barrier layer and the barrier layer adheres to the bitumen primer layer and a coating of stone chips applied to said barrier layer in a manner such that the stone chips are partially embedded at least in the barrier layer, which has a viscosity and surface tension that permits capillarization by the barrier layer around the chips so that the stone chips are held in position on curing of the bitumen primer and barrier layer but the stone chips are not completely covered by the barrier layer.

In a still further aspect, the invention consists in a coated article comprising a base sheet material, a bitumen primer layer applied to said base sheet material, an ultraviolet apaque barrier layer applied to said bitumen primer layer while said bitumen layer is still wet, said barrier material being of a consistency, composition and thickness such that the bitumen primer layer does not bleed through the barrier layer and the barrier layer adheres to the bitumen primer layer and a coating of stone chips applied to the barrier layer in a manner such that the stone chips are partially embedded at least in the barrier layer, which has a viscosity and surface tension that permits capillarization by the barrier layer around the chips so that the stone chips are held in position on curing of the bitumen primer and barrier layer but the stone chips are not completely covered by the barrier layer.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF THE DRAWINGS

One preferred form of the invention and modifications thereof will now be described with reference to the accompanying drawings in which.

DESCRIPTION OF THE PREFERRED EMBODIMENTS

Figure 1:
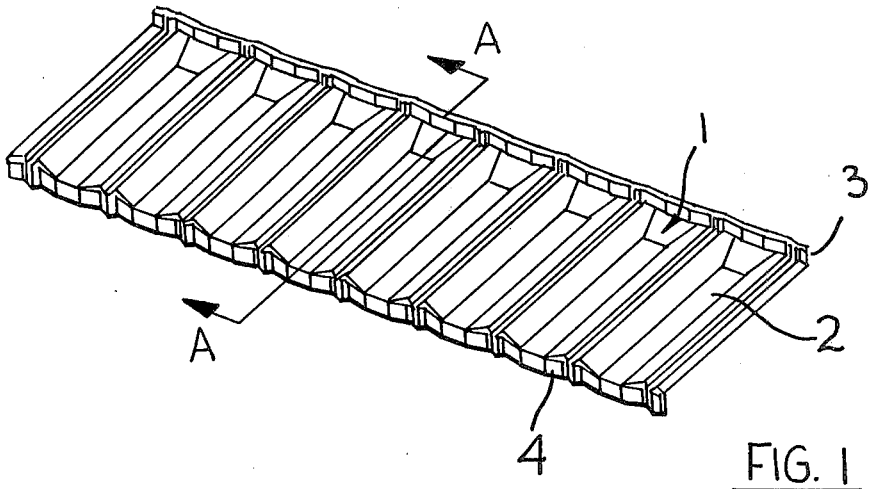
FIG. 1 is a perspective view of one form of uncoated tile useable in the invention.

In the preferred form of the invention a roofing tile which may be of a suitable shape such as uncoated tile 1 shown in FIG. 1 and having an upper surface 2 with upturned flange 3 and downturned flange 4 to allow overlapping of adjacent tiles in use.

Figure 2:
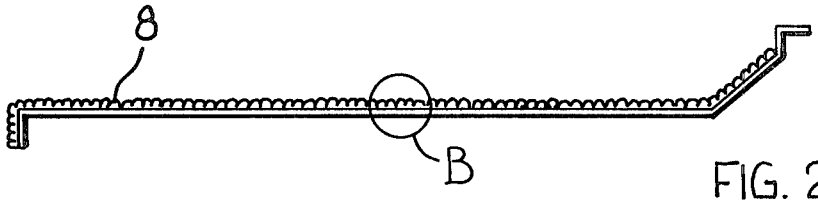
FIG. 2 is a cross section on AA in FIG. 1.
Figure 3:
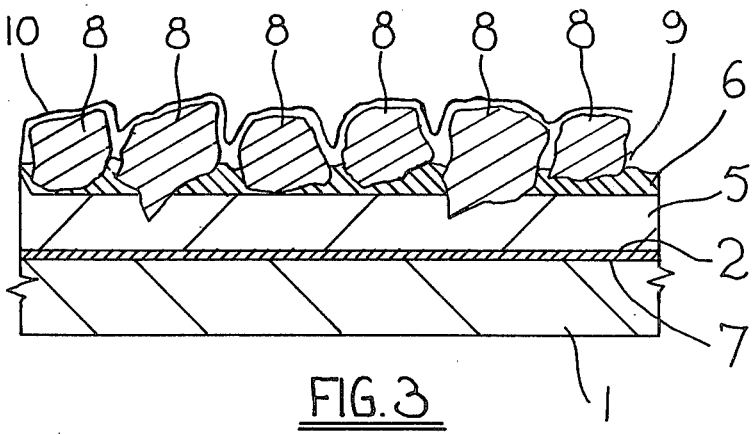
FIG. 3 is an enlargement of section B in FIG. 2.

The uncoated roofing tile 1 is made of galvanished sheet metal and has applied to its upper surface 2, a base layer 5 of bitumen primer, preferably either a polymer modified bitumen emulsion or a bitumen emulsion an example of which is that available under the trademark "BITUMASTIC". The bitumen primer is preferably applied by a spraying process while wet, that is to say, while still containing enough water so that the material of layer 5 will flow under operating conditions. The thickness of the coating is suitably selected to give a layer 5 which, as shown in FIG. 2 and in enlarged section in FIG. 3, is thicker than the barrier layer. The thickness, in part, being determined by its water content, and ideally to give a layer 5 is one containing 20%–40% water at the time of application, preferably less than 30%. Fillers may be included in the layer 5 such as calcium carbonate to extend the material and also provide a buffer for alkalinity. Platey fillers such as water ground mica may be added to improve mechanical properties and weathering characteristics and also anti corrosive pigments may be added. The emulsion when polymer modified is preferably polymer modified by adding a styrene acrylic emulsion for example about 20% on solids by weight or any other material having compatible high extensibility and low modulus of elasticity compared with the bitumen emulsion before polymer modification. A barrier layer 6 is then applied. The thickness of the barrier layer 6 is about 100 microns while wet, and to substantially prevent excessive intermingling of layers 5 and 6, which would allow bleeding of the bitumen primer layer 5 through the barrier 6, control is exercised by choice of polymer for the barrier layer 6, control of surfactant system in both layers 5 and 6 and moisture content in the bitumen primer layer 5. The surfactants used are based on a mixture of non-ionic and anionic surfactants and must be used to cause the layers 5 and 6 to be stable in the wet state. However excessive surfactant will detract from the properties of layers 5 and 6 themselves. The surfactants in each layer must be reasonably compatible, and act in emulsifying the materials of layers 5 and 6 to give a relatively stable system.

Preferably the bitumen primer layer 5 is not allowed to dry out or if drying is permitted the water content is not reduced below 15% and immediately after the bitumen primer layer 5 has been applied or within a short time after application the barrier layer is applied and this barrier layer preferably comprises an ultra violet opaque material, such as an acrylic material and preferably that acrylic material comprises an elastomeric acrylic emulsion for example Rohm & Haas LC 45 or Revertex Revacryl EM3608.

The requirements of the bitumen primer layer 5 and the barrier 6 are as follows.

There must be inter layer adhesion as between any zinc coating 7 or the sheet steel 1 and the bitumen primer layer 5 and between the bitumen primer layer 5 and the barrier layer 6. Intermingling of the barrier layer 6 and the bitumen primer layer 5 needs to be within specific limits:

a. too little will lead to limited adhesion
b. too much will lead to bleeding of the bitumen primer through the barrier layer 6 and subsequent reduced weather resistance.

Consequently these are the limits of intermingling required and can be controlled by controlling the thickness of the layers, the rheology of the layers, the surfactant system and the time interval between applying the bitumen primer layer and the barrier layer. The intermingling of the layers is effectively on a microscopic scale so that the layers 5 and 6 are in effect separate layers. The wet on wet process outlined above leads to better bonding when compared with a wet on dry process. The preferred coating system includes a polymer modified bitumen emulsion primer and a filled highly extensible barrier coat utilising polymers such as totally or partly acrylic polymers.

After the bitumen primer layer 5 and the barrier layer 6 have been applied a stone chip material 8, such as that as used at present on Decramastic (trade mark) tiles and Harveytile tiles (trade mark), is applied to the still wet surface of the barrier layer 6 and the chip 8 is such that the chips 8 are embedded but only partly embedded within at least the barrier layer 6 and possibly extending into the bitumen primer layer 5. The barrier coat 6 viscosity and surface tension must be such that the barrier coat 6 capillarises part way up the side 9 of the chips 8 but without totally covering the chips 8. A moderately high viscosity is required but must be below a certain limit so that the material will flow out but then structure up to reduced sag. Many acrylic coatings will achieve this property and the barrier layer must be controlled by selection of surface tension and viscosity characteristics so that the relatively thin barrier coat (within the range of 70 microns to 130 microns) is not excessively depleted by excessive capillarisation. The chip specification needs to be such that reasonable grip is provided by the barrier layer 6 of the chips 8, that is to say, the chips 8 must not be so big that only a small portion thereof is embedded in the barrier layer which would result in excessive loss of chip in use.

After the chip has been applied an overglaze layer 10 is applied and such overglaze layer 10 preferably comprises a transparent overglaze such as an acrylic emulsion overglaze such as a 100% unfilled acrylic overglaze.

It is desirable that the water content increases upwardly through layers 5, 6 and 10 to ensure adequate drying. Thus layer 5 may have a wate content of 20%–40%, layer 6 a water content of 40%–50% and layer 10 a water content of 50%–60%.

The advantages of the above coating system include:

1. An improved chip bond as compared with present products. Because of the capillary attraction between chip and barrier there is no depression therebetween in which growth such as lichen can take hold.
2. Improved weather resistance due to, in particular, the bitumen rich layer being protected from ultra violet degradation by the barrier layer.
3. Improved fungal resistance.
4. Improved scuff resistance during handling and fixing resulting in a better weathering property over a longer period of time.
5. Lower cost compared with all acrylic coatings.
6. Pre-treatment of galvanized surface can be minimized without substantial deleterious effect.

We claim:

1. A coated article comprising a base sheet material comprising an uncoated galvanized sheet metal tile and a composite coating comprising a bitumen primer layer applied as an emulsion to said base sheet material, an ultraviolet opaque barrier layer applied to said bitumen primer layer while said bitumen primer layer has a water content of between 20% and 40% by weight, said barrier material being of a consistency, composition and thickness such that the bitumen primer layer does not bleed through the barrier layer and the barrier layer adheres to the bitumen primer layer and a coating of stone chips applied to the barrier layer in a manner such that the stone chips are partially embedded at least in the barrier layer, said barrier layer having a viscosity and surface tension which permits capillarization by said barrier layer around said chips to occur so that the stone chips are held in position on curing of the bitumen primer layer but the stone chips are not completely covered by the barrier layer.

2. An article as claimed in claim 1 wherein said article comprises a roofing tile.

3. An article as claimed in claim 1 wherein the composite coating is finally covered with a layer of transparent or translucent material.

4. A coated article as claimed in claim 1, wherein said barrier layer is formed from a material other than the material which forms the bitumen primer layer and is applied as an emulsion having a water content of between 40% and 50% by weight.

5. A method of coating articles, said method comprising the steps of applying to a base sheet material comprising an uncoated galvanized sheet metal tile, a bitumen primer layer as an emulsion and while the bitumen primer layer has a water content of between 20% and 40% by weight applying a layer of an ultraviolet-opaque barrier material of a consistency, composition and thickness such that the bitumen primer layer does not bleed through the barrier layer and the barrier layer adheres to the bitumen primer layer and applying a coating of stone chips to the barrier layer in a manner such that the stone chips are partially embedded at least in the barrier layer, said barrier layer having a viscosity and surface tension which permits capillarization by said barrier layer around said chips to occur so that the stone chips are held in position on curing of the bitumen primer layer and barrier layer but the stone chips are not completely covered by the barrier layer.

6. A method as claimed in claim 5 wherein said bitumen primer layer comprises a polymer modified bitumen emulsion layer.

7. A method as claimed in claim 5 wherein said barrier layer comprises an acrylic emulsion.

8. A method as claimed in claim 5, wherein said barrier layer is formed from a material other than the material which forms the bitumen primer layer and is applied as an emulsion having a water content of between 40% and 50% by weight.

* * * * *